US008739576B2

(12) United States Patent
Tobi et al.

(10) Patent No.: US 8,739,576 B2
(45) Date of Patent: Jun. 3, 2014

(54) WASHING/DRYING MACHINE AND DEODORIZATION APPARATUS

(75) Inventors: Yukio Tobi, Gunma (JP); Haruo Mamiya, Shiga (JP); Takayoshi Akagi, Gunma (JP)

(73) Assignees: Haier Group Corporation, Qingdao, Shandong (CN); Qingdao Haier Washing Machine Co., Ltd., Qingdao, Shandong (CN)

( * ) Notice: Subject to any disclaimer, the term of this patent is extended or adjusted under 35 U.S.C. 154(b) by 1013 days.

(21) Appl. No.: 12/810,698

(22) PCT Filed: Sep. 4, 2008

(86) PCT No.: PCT/JP2008/065992

§ 371 (c)(1),
(2), (4) Date: Jun. 25, 2010

(87) PCT Pub. No.: WO2009/084281

PCT Pub. Date: Jul. 9, 2009

(65) Prior Publication Data

US 2010/0281924 A1 Nov. 11, 2010

(30) Foreign Application Priority Data

Dec. 28, 2007 (JP) ..... 2007-339393

(51) Int. Cl.
*B08B 3/12* (2006.01)
*D06F 37/00* (2006.01)

(52) U.S. Cl.
USPC ..... 68/3 R

(58) Field of Classification Search
None
See application file for complete search history.

(56) References Cited

U.S. PATENT DOCUMENTS

| | | | |
|---|---|---|---|
| 2009/0049874 | A1 | 2/2009 | Mamiya et al. |
| 2009/0255299 | A1 | 10/2009 | Hiro et al. |
| 2009/0260404 | A1 | 10/2009 | Saito et al. |

FOREIGN PATENT DOCUMENTS

| | | | |
|---|---|---|---|
| JP | 2007-195896 | A | 8/2007 |
| JP | 2007-313006 | | 12/2007 |
| JP | 2007-313231 | A | 12/2007 |
| WO | WO 2007/043326 | A1 | 4/2007 |

OTHER PUBLICATIONS

Hiro et al., Apr. 2007, WO 2007/043326, English machine translation.*

* cited by examiner

*Primary Examiner* — Jason Ko
(74) *Attorney, Agent, or Firm* — Rabin & Berdo, P.C.

(57) ABSTRACT

The inventive washing machine is capable of deodorizing a daily commodity with cleaning air in a shorter period of time. When the daily commodity is deodorized with the cleaning air, a control section (120) causes a heater (100) to heat air in a washing tub (3) to maintain an inside air temperature of the washing tub (3) within a predetermined temperature range. This promotes the deodorization with the cleaning air, as long as the cleaning air is not decomposed by the heating. As a result, the daily commodity can be satisfactorily deodorized irrespective of an operation period set by a timer (122), for example, even if a daily commodity deodorization process is performed with the use of the cleaning air in a shorter period of time (a minimum air-wash process is performed).

8 Claims, 8 Drawing Sheets

WASHING/DRYING MACHINE AND DEODORIZATION APPARATUS

TECHNICAL FIELD

The present invention relates to a washing/drying machine and a deodorization apparatus.

BACKGROUND ART

There is know a washing machine which includes a drum (corresponding to a washing tub) provided in a housing thereof and is adapted to wash laundry contained in the drum. There is also known a washing machine which is adapted to supply ozone-containing air (also called "cleaning air") into a drum thereof to deodorize laundry in the drum with the cleaning air (see, for example, Patent Document 1).

The washing machine disclosed in Patent Document 1 performs a laundry cleaning process (called "air-wash process") with the use of the cleaning air independently of an ordinary laundry process and a drying process.

Patent Document 1: JP-A-2007-195896

DISCLOSURE OF THE INVENTION

Problems to be Solved by the Invention

Since the ozone-containing cleaning air emanates ozone odor that is offensive to a user, it is necessary to prevent the cleaning air from leaking out of the housing.

In the air-wash process, therefore, a preparatory operation should be performed for a predetermined period for isolating a cleaning-air spreading area of the housing from the outside (or sealing the cleaning-air spreading area) before the cleaning air is supplied into the drum. Further, a post operation should be performed for a predetermined period for eliminating the ozone contained in the cleaning air in the housing.

In the washing machine disclosed in Patent Document 1, the air-wash process is typically performed, for example, for 30 minutes. Where the user does not have enough time just before going out or where the laundry is less odorous, it is desired to perform the air-wash process in a shorter period of time than usual.

Even if the air-wash process is performed in a shorter period, however, the preparatory operation and the post operation described above should be preformed for the predetermined periods. Therefore, a net period during which the cleaning air is supplied into the drum is significantly reduced as compared with the typical air-wash process. Where the air-wash process is performed in a shorter period, the amount of the cleaning air supplied into the drum is insufficient, making it impossible to satisfactorily deodorize the laundry.

Further, it is convenient if not only the garment but also daily commodities such as shoes, hats and bags can be deodorized as the laundry.

In view of the foregoing, it is a principal object of the present invention to provide a washing/drying machine which is capable of satisfactorily deodorizing a daily commodity with the use of cleaning air even if the deodorization process is performed in a shorter period of time.

It is another object of the present invention to provide a deodorization apparatus which is capable of satisfactorily deodorizing a daily commodity with the use of cleaning air even if the deodorization process is performed in a shorter period of time.

Means for Solving the Problems

According to a first aspect of the present invention, there is provided a washing/drying machine which has a deodorization function for deodorizing a daily commodity by using cleaning air, and includes: a washing tub; a water supply passage through which water is supplied into the washing tub, the water supply passage having a water supply trap portion; a drain passage through which water is drained out of the washing tub from a drain port, the drain passage having a drain trap portion; heating means which heats air in the washing tub; cleaning air supply means which supplies the cleaning air into the washing tub; cleaning air elimination means which eliminates the cleaning air supplied into the washing tub; operation period setting means which sets a deodorization operation period; and control means which forms traps in the water supply trap portion and the drain trap portion based on an operation start signal, causes the cleaning air supply means to supply the cleaning air after the formation of the traps, causes the heating means to heat the air in the washing tub to maintain an inside air temperature of the washing tub within a predetermined temperature range, and causes the cleaning air supply means to stop the supply of the cleaning air and turns on the cleaning air elimination means a predetermined period before an end of the deodorization operation period set by the operation period setting means so as to eliminate the supplied cleaning air by the end of the deodorization operation period set by the operation period setting means.

In the inventive washing/drying machine, the heating means includes a heater which is driven selectively at a higher output level and at a lower output level, and the control means drives the heater at the lower output level to maintain the inside air temperature of the washing tub within the predetermined temperature range if the operation period set by the operation period setting means is an operation period other than a predetermined minimum operation period.

In the inventive washing/drying machine, the control means drives the heater at one of the higher output level and the lower output level to maintain the inside air temperature of the washing tub within the predetermined temperature range if the operation period set by the operation period setting means is the predetermined minimum operation period.

In the inventive washing/drying machine, the washing tub includes an additional water passage provided separately from the water supply passage for supplying water directly to the drain port of the washing tub, and the control means supplies a predetermined amount of water into the water supply passage to retain water in the water supply trap portion to form a water supply trap, and supplies a predetermined amount of water directly into the drain port through the additional water passage to retain water in the drain trap portion to form a drain trap.

The inventive washing/drying machine further includes a circulation air duct having opposite ends connected to the washing tub, and blower means which circulates air from the washing tub through the circulation air duct, and the cleaning air elimination means drives the blower means in a predetermined manner to circulate the air from the washing tub.

According to a second aspect of the present invention, there is provided a washing/drying machine which has a deodorization function for deodorizing a daily commodity by using cleaning air, and includes: a sealable washing tub; heating means which heats air in the washing tub; cleaning air supply means which supplies the cleaning air into the washing tub; cleaning air elimination means which eliminates the cleaning air supplied into the washing tub; operation period setting means which sets a deodorization operation period; and control means which causes the cleaning air supply means to supply the cleaning air based on an operation start signal, causes the heating means to heat the air in the washing tub to maintain an inside air temperature of the washing tub within a predetermined temperature range, and causes the cleaning air supply means to stop the supply of the cleaning air and turns on the cleaning air elimination means a predetermined period before an end of the deodorization operation period set by the operation period setting means so as to eliminate the supplied cleaning air by the end of the deodorization operation period set by the operation period setting means.

In the inventive washing/drying machine, the heating means includes a heater which is driven selectively at a higher output level and at a lower output level, and the control means drives the heater at the lower output level to maintain the inside air temperature of the washing tub within the predetermined temperature range if the operation period set by the operation period setting means is an operation period other than a predetermined minimum operation period.

In the inventive washing/drying machine, the control means drives the heater at one of the higher output level and the lower output level to maintain the inside air temperature of the washing tub within the predetermined temperature range if the operation period set by the operation period setting means is the predetermined minimum operation period.

The inventive washing/drying machine further includes a circulation air duct having opposite ends connected to the washing tub, and blower means which circulates air from the washing tub through the circulation air duct, and the cleaning air elimination means drives the blower means in a predetermined manner to circulate the air from the washing tub.

According to a third aspect of the present invention, there is provided a deodorization apparatus which deodorizes a daily commodity by using cleaning air, and includes: a sealable container chamber; heating means which heats air in the container chamber; cleaning air supply means which supplies the cleaning air into the container chamber; cleaning air elimination means which eliminates the cleaning air supplied into the container chamber; operation period setting means which sets an operation period; and control means which causes the cleaning air supply means to supply the cleaning air based on an operation start signal, causes the heating means to heat the air in the container chamber to maintain an inside air temperature of the container chamber within a predetermined temperature range, and causes the cleaning air supply means to stop the supply of the cleaning air and turns on the cleaning air elimination means a predetermined period before an end of the operation period set by the operation period setting means so as to eliminate the supplied cleaning air by the end of the operation period set by the operation period setting means.

In the inventive deodorization apparatus, the heating means includes a heater which is driven selectively at a higher output level and at a lower output level, and the control means drives the heater at the lower output level to maintain the inside air temperature of the container chamber within the predetermined temperature range if the operation period set by the operation period setting means is an operation period other than a predetermined minimum operation period.

In the inventive deodorization apparatus, the control means drives the heater at one of the higher output level and the lower output level to maintain the inside air temperature of the container chamber within the predetermined temperature range if the operation period set by the operation period setting means is the predetermined minimum operation period.

In the inventive deodorization apparatus, the cleaning air elimination means includes blower means which agitates the air in the container chamber.

Effects of the Invention

The washing/drying machine according to the first aspect of the present invention has the deodorization function and is therefore capable of deodorizing daily commodities such as garment, shoes, a hat and a bag with the use of the cleaning air. An example of the cleaning air is ozone.

More specifically, the control means forms the traps in the water supply trap portion of the water supply passage and in the drain trap portion of the drain passage based on the operation start signal prior to the deodorization of the daily commodity. Therefore, the washing tub is sealed. After the formation of the traps, the daily commodity retained in the washing tub is deodorized with the cleaning air supplied into the washing tub by the cleaning air supply means. Since the washing tub is sealed at this time, there is no fear that the cleaning air leaks out of the washing/drying machine from the washing tub.

When the daily commodity is deodorized with the cleaning air, the control means causes the heating means to heat the air in the washing tub to maintain the inside air temperature of the washing tub within the predetermined temperature range. Therefore, the deodorization with the cleaning air can be promoted, as long as the cleaning air is not decomposed by the heating. As a result, the daily commodity can be satisfactorily deodorized with the cleaning air irrespective of the operation period set by the operation period setting means, for example, even if the deodorization of the daily commodity is carried out in a shorter period of time.

Then, the control means causes the cleaning air supply means to stop the supply of the cleaning air and turns on the cleaning air elimination means the predetermined period before the end of the deodorization operation period set by the operation period setting means so as to eliminate the cleaning air supplied into the washing tub by the end of the deodorization operation period set by the operation period setting means. Thus, even if the daily commodity is deodorized with the cleaning air in a shorter period of time, as described above, the cleaning air supplied into the washing tub is eliminated by the end of the deodorization operation period. Therefore, the user does not feel uncomfortable with the odor of the cleaning air when taking the daily commodity out of the washing tub.

According to the present invention, if the operation period set by the operation period setting means is an operation period other than the predetermined minimum operation period, the control means drives the heater (which is driven selectively at the higher output level and at the lower output level) at the lower output level to maintain the inside air temperature of the washing tub within the predetermined temperature range. Therefore, the inside air temperature of the washing tub can be maintained within the predetermined temperature range without needlessly driving the heater at the higher output level.

According to the present invention, if the operation period set by the operation period setting means is the predetermined minimum operation period, the control means drives the heater at the higher output level or at the lower output level to maintain the inside air temperature of the washing tub within the predetermined temperature range. Therefore, the inside air temperature of the washing tub can be efficiently maintained within the predetermined temperature range in a limited period of time.

According to the present invention, the washing tub includes the additional water passage provided separately from the water supply passage for supplying water directly to the drain port of the washing tub. The control means supplies the predetermined amount of water into the water supply passage to retain the water in the water supply trap portion to form the water supply trap, and supplies the predetermined amount of water into the drain port through the additional water passage to retain the water in the drain trap portion to form the drain trap. That is, the predetermined amount of water is supplied into the drain port through the additional water passage rather than through the water supply passage for the formation of the drain trap. Therefore, the formation of the drain trap can be achieved without wetting the daily commodity retained in the washing tub.

According to the present invention, the cleaning air elimination means drives the blower means in the predetermined manner to circulate the cleaning air from the washing tub through the circulation air duct. Thus, the cleaning air supplied into the washing tub can be reliably eliminated by such a simple operation.

The washing/drying machine according to the second aspect of the present invention has the deodorization function and is therefore capable of deodorizing daily commodities such as garment, shoes, a hat and a bag with the use of the cleaning air. An example of the cleaning air is ozone.

More specifically, the daily commodity retained in the washing tub is deodorized with the cleaning air supplied into the washing tub by the cleaning air supply means. Since the washing tub is sealed at this time, there is no fear that the cleaning air leaks out of the washing/drying machine from the washing tub.

When the daily commodity is deodorized with the cleaning air, the control means causes the heating means to heat the air in the washing tub to maintain the inside air temperature of the washing tub within the predetermined temperature range. Therefore, the deodorization with the cleaning air can be promoted, as long as the cleaning air is not decomposed by the heating. As a result, the daily commodity can be satisfactorily deodorized with the cleaning air irrespective of the operation period set by the operation period setting means, for example, even if the deodorization of the daily commodity is carried out in a shorter period of time.

Then, the control means causes the cleaning air supply means to stop the supply of the cleaning air and turns on the cleaning air elimination means the predetermined period before the end of the deodorization operation period set by the operation period setting means so as to eliminate the cleaning air supplied into the washing tub by the end of the deodorization operation period set by the operation period setting means. Thus, even if the daily commodity is deodorized with the cleaning air in a shorter period of time, as described above, the cleaning air supplied into the washing tub is eliminated by the end of the deodorization operation period. Therefore, the user does not feel uncomfortable with the odor of the cleaning air when taking the daily commodity out of the washing tub.

According to the present invention, if the operation period set by the operation period setting means is an operation period other than the predetermined minimum operation period, the control means drives the heater (which is driven selectively at the higher output level and at the lower output level) at the lower output level to maintain the inside air temperature of the washing tub within the predetermined temperature range. Therefore, the inside air temperature of the washing tub can be maintained within the predetermined temperature range without needlessly driving the heater at the higher output level.

According to the present invention, if the operation period set by the operation period setting means is the predetermined minimum operation period, the control means drives the heater at the higher output level or at the lower output level to maintain the inside air temperature of the washing tub within the predetermined temperature range. Therefore, the inside air temperature of the washing tub can be efficiently maintained within the predetermined temperature range in a limited period of time.

According to the present invention, the cleaning air elimination means drives the blower means in the predetermined manner to circulate the cleaning air from the washing tub through the circulation air duct. Thus, the cleaning air supplied into the washing tub can be reliably eliminated by such a simple operation.

The deodorization apparatus according to a third aspect of the present invention is capable of deodorizing daily commodities such as garment, shoes, a hat and a bag with the use of the cleaning air. An example of the cleaning air is ozone.

More specifically, the daily commodity retained in the container chamber is deodorized with the cleaning air supplied into the container chamber by the cleaning air supply means. Since the container chamber is sealed at this time, there is no fear that the cleaning air leaks out of the deodorization apparatus from the container chamber.

When the daily commodity is deodorized with the cleaning air, the control means causes the heating means to heat the air in the container chamber to maintain the inside air temperature of the container chamber within the predetermined temperature range. Therefore, the deodorization with the cleaning air can be promoted, as long as the cleaning air is not decomposed by the heating. As a result, the daily commodity can be satisfactorily deodorized with the cleaning air irrespective of the operation period set by the operation period setting means, for example, even if the deodorization of the daily commodity is carried out in a shorter period of time.

Then, the control means causes the cleaning air supply means to stop the supply of the cleaning air and turns on the cleaning air elimination means the predetermined period before the end of the operation period set by the operation period setting means so as to eliminate the cleaning air supplied into the container chamber by the end of the operation period set by the operation period setting means. Thus, even if the daily commodity is deodorized with the cleaning air in a shorter period of time, as described above, the cleaning air supplied into the container chamber is eliminated by the end of the operation period. Therefore, the user does not feel uncomfortable with the odor of the cleaning air when taking the daily commodity out of the container chamber.

According to the present invention, if the operation period set by the operation period setting means is an operation period other than the predetermined minimum operation period, the control means drives the heater (which is driven selectively at the higher output level and at the lower output level) at the lower output level to maintain the inside air temperature of the container chamber within the predetermined temperature range. Therefore, the inside air temperature of the container chamber can be maintained within the predetermined temperature range without needlessly driving the heater at the higher output level.

According to the present invention, if the operation period set by the operation period setting means is the predetermined minimum operation period, the control means drives the heater at the higher output level or at the lower output level to maintain the inside air temperature of the container chamber within the predetermined temperature range. Therefore, the inside air temperature of the container chamber can be efficiently maintained within the predetermined temperature range in a limited period of time.

According to the present invention, the cleaning air supplied into the container chamber can be reliably eliminated simply by agitating the cleaning air in the container chamber by the blower means of the cleaning air elimination means.

DESCRIPTION OF REFERENCE CHARACTERS

Figure 1:
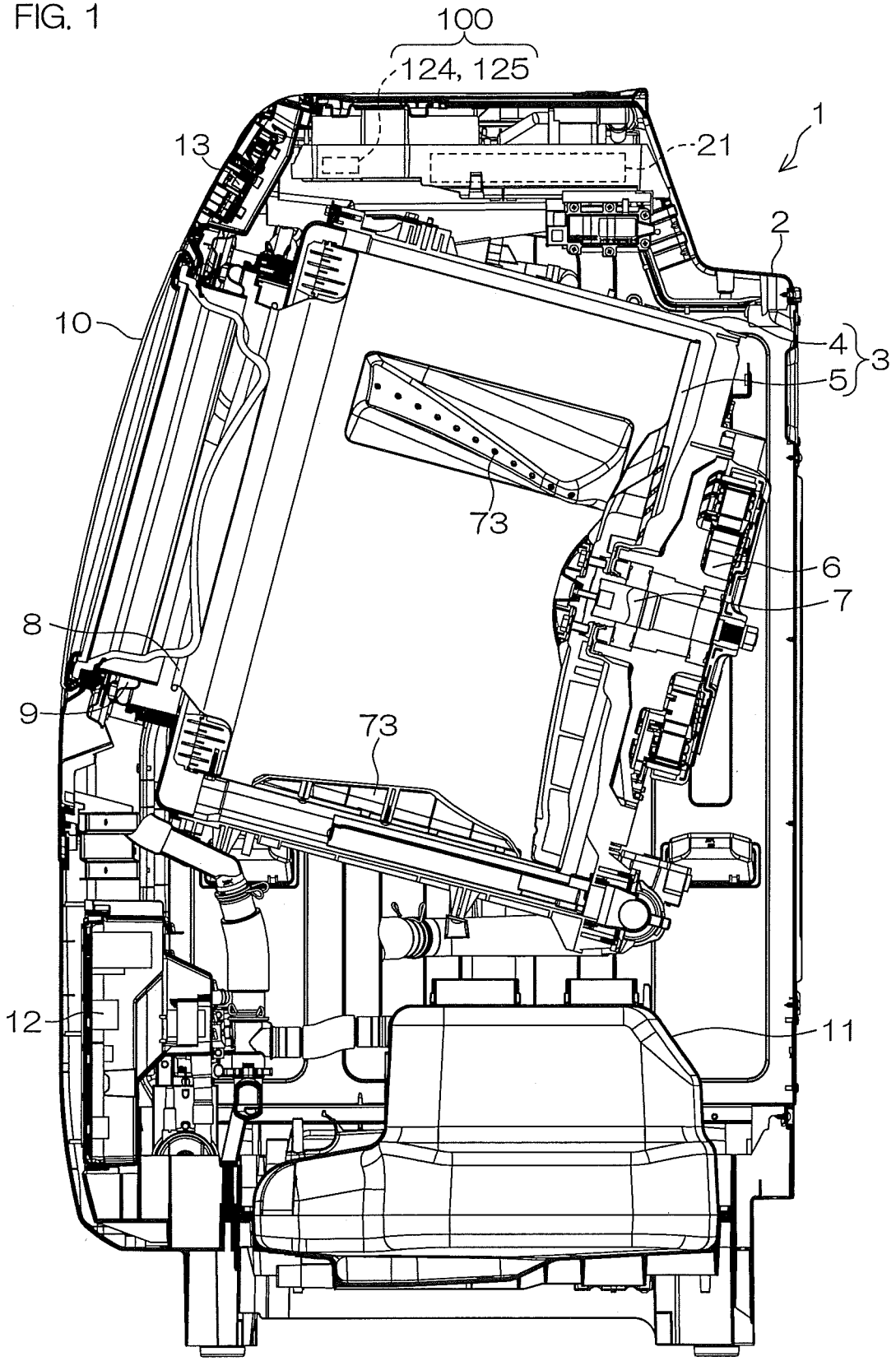
FIG. 1 is a right side view illustrating, in vertical section, a washing/drying machine 1 according to one embodiment of the present invention.

1: Washing/drying machine
3: Washing tub
19: Ozone generator
20: Drying air duct
21: Blower
30: Water supply passage
39: Water passage
41: Water passage
42: Drain port
49: Drain passage
68: Water supply trap portion
69: Drain trap portion
70: Filter blower unit
71: Air tube
90: Deodorization apparatus
91: Container chamber
92: Heater
93: Ozone supply device
94: Fan
100: Heater
120: Control section
122: Timer

BEST MODE FOR CARRYING OUT THE INVENTION

With reference to the attached drawings, a washing/drying machine 1 (deodorization apparatus) according to one embodiment of the present invention will hereinafter be described in detail.

Construction and Operation of Washing/Drying Machine

FIG. 1 is a right side view illustrating, in vertical section, the washing/drying machine 1 according to the embodiment of the present invention.

As shown in FIG. 1, the washing/drying machine 1 includes a washing tub 3 disposed obliquely in a housing 2. The washing tub 3 includes an outer tub 4 in which water is retained in a laundry process, and a drum 5 rotatably accommodated in the outer tub 4. The drum 5 is rotated about a rotation shaft 7 by a DD motor 6 provided rearward of the outer tub 4. The rotation shaft 7 extends obliquely upward toward the front to provide a so-called oblique drum structure. An opening 8 of the drum 5 and an opening 9 of the outer tub 4 are covered and uncovered with a door 10 attached to the housing 2. With the door 10 being opened, garment (laundry) is loaded into and unloaded from the drum 5 through the openings 8, 9.

The washing/drying machine 1 includes a tank 11 provided below the washing tub 3 for storing used water (recycling water). The tank 11 has an internal volume of about 8.5 liters. Water used for a rinsing operation is stored in the tank 11, and is used as heat-exchange water and cleaning water for removing lint and the like from an air circulation duct in a drying process.

An operation/display section 13 is disposed on an upper portion of a front face of the housing 2 (above the door 10). A plurality of operation keys (not shown) and a display device (not shown) are arranged in the operation/display section 13. By operating the operation keys (not shown), the operation of the washing/drying machine 1 is controlled, and the operation status of the washing/drying machine 1 is displayed on the display device (not shown).

Further, a blower 21 (cleaning air elimination means and blower means) to be rotatively driven in the drying process to be described later, and a heater 100 (heating means) for heating air circulated into the washing tub 3 by the blower 21 (i.e., for heating air in the washing tub 3) are provided in an upper portion of the housing 2. The heater 100 includes a drying heater A 124 and a drying heater B 125.

Figure 2:
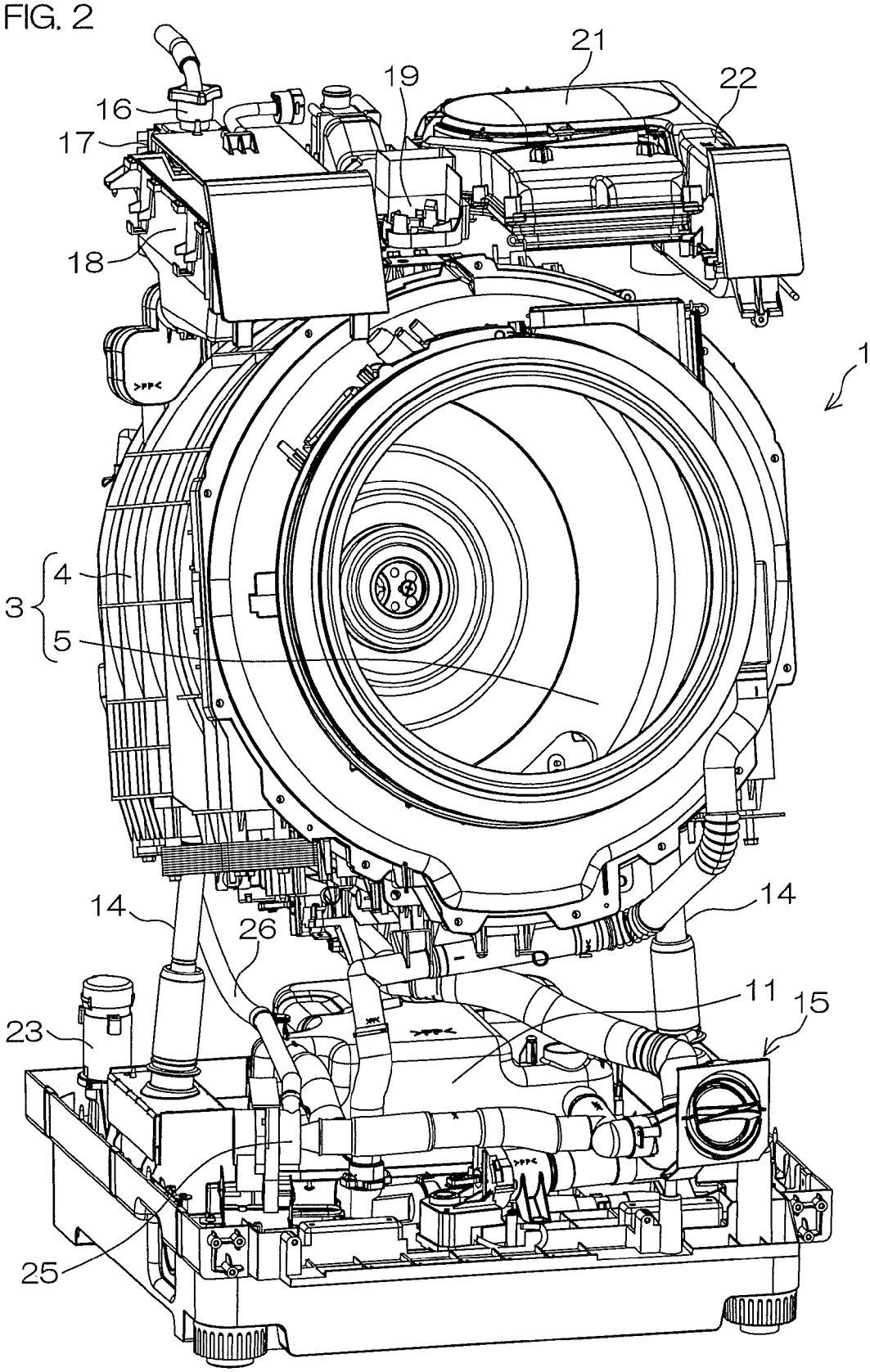
FIG. 2 is a perspective view showing the internal construction of the washing/drying machine 1 according to the embodiment of the present invention with its housing 2 removed as seen obliquely from the front side.
Figure 3:
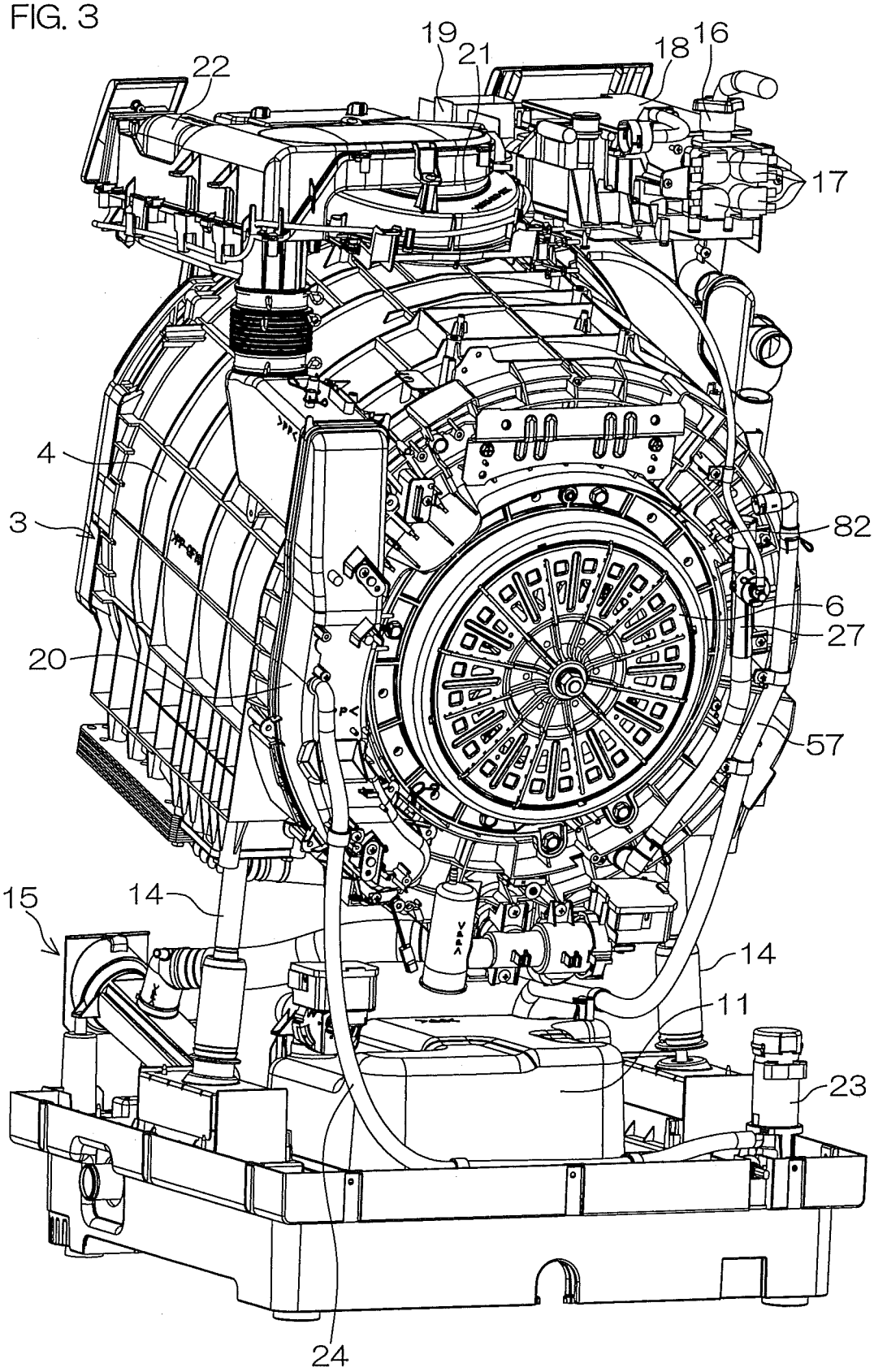
FIG. 3 is a perspective view showing the internal construction of the washing/drying machine 1 with its housing 2 removed as seen obliquely from the rear side.

FIG. 2 is a perspective view showing the internal construction of the washing/drying machine 1 according to the embodiment of the present invention with the housing 2 removed as seen obliquely from the front side. FIG. 3 is a perspective view showing the internal construction of the washing/drying machine 1 with the housing 2 removed as seen obliquely from the rear side.

In FIGS. 2 and 3, the reference numeral 3 denotes the washing tub, which includes the outer tub 4 and the drum 5. The washing tub 3 is supported by resilient support members 14 each including a coil spring and a damper. The tank 11 is disposed below the washing tub 3. A filter unit 15 is disposed on a front right side of the tank 11, and connected to the washing tub 3 and the tank 11 through predetermined hoses and pipes.

A water plug 16, a water supply valve 17 for controlling supply of water flowing from the water plug 16 into a water passage, a water supply port unit 18, an ozone generator 19 which generates ozone (cleaning air), the blower 21 for circulating air through a drying air duct 20 (air circulation duct) in the drying process, and a drying filter unit 22 for trapping foreign matter such as lint contained in the air circulated through the drying air duct 20 by the blower 21 are provided above the washing tub 3.

In the laundry process (a washing step or a rinsing step), tap water supplied from the water plug 16 is retained in the washing tub 3 by controlling the water supply valve 17. At this time, water containing a detergent dissolved therein can be retained in the washing tub 3 by causing water to flow into the washing tub 3 through a detergent container 29 (see FIG. 4) in the water supply port unit 18. In the laundry process, the drum 5 is rotated by the DD motor 6. Further, the water is pumped out of the washing tub 3 through the filter unit 15 by a circulation pump 25, and the pumped water is guided to a rear upper side of the outer tub 4 through a water circulation passage (second water circulation passage 57) and flows down from the upper side and then back into the washing tub 3 from a lower portion of a rear face of the washing tub 3 (outer tub 4) for circulation. A gas-liquid mixer 27 is provided in the water circulation passage, and the ozone generated by the ozone generator 19 is mixed with the water flowing down from the upper side in the gas-liquid mixer 27. With the ozone mixed with the water, the water is cleaned by the strong oxidation and sterilization power of the ozone. That is, the water in the washing tub 3 is circulated in the laundry process, and cleaned by mixing the ozone with the circulated water for use in the laundry process. As shown in FIG. 3, a projection 82 is provided in the vicinity of the gas-liquid mixer 27 as projecting rearward from the rear face of the outer tub 4 for protecting the gas-liquid mixer 27 attached to the rear face of the outer tub 4 when the outer tub 4 is wobbled to bump against the housing 2 (see FIG. 1).

In the drying process, air is sucked out of the washing tub 3 from a lower portion of the rear face of the washing tub 3, and guided upward through the drying air duct 20. After foreign matter is filtered away from the air by the drying filter unit 22, the air flows into the washing tub 3 from an upper front side of the washing tub 3 for circulation. High-temperature high-humidity air is heat-exchanged with water to be thereby cooled and dehumidified when being circulated through the drying air duct 20. For this purpose, water is supplied into the drying air duct 20. That is, the washing/drying machine is configured such that water is pumped up from the tank 11 by a drying pump 23, and supplied to a predetermined portion (first position) of the drying air duct 20 via a duct water supply passage 24 such as of a hose. Though not shown, a water passage for supplying the tap water into the drying air duct 20 from the water plug 16 via the water supply valve 17 as required is also provided.

While the construction and the operation of the washing/drying machine 1 have been thus described, the overall construction, particularly water passages and air passages, of the washing/drying machine 1 will be described in detail with reference to FIG. 4.

Arrangement of Water Passages and Air Passages of Washing/Drying Machine

Figure 4:
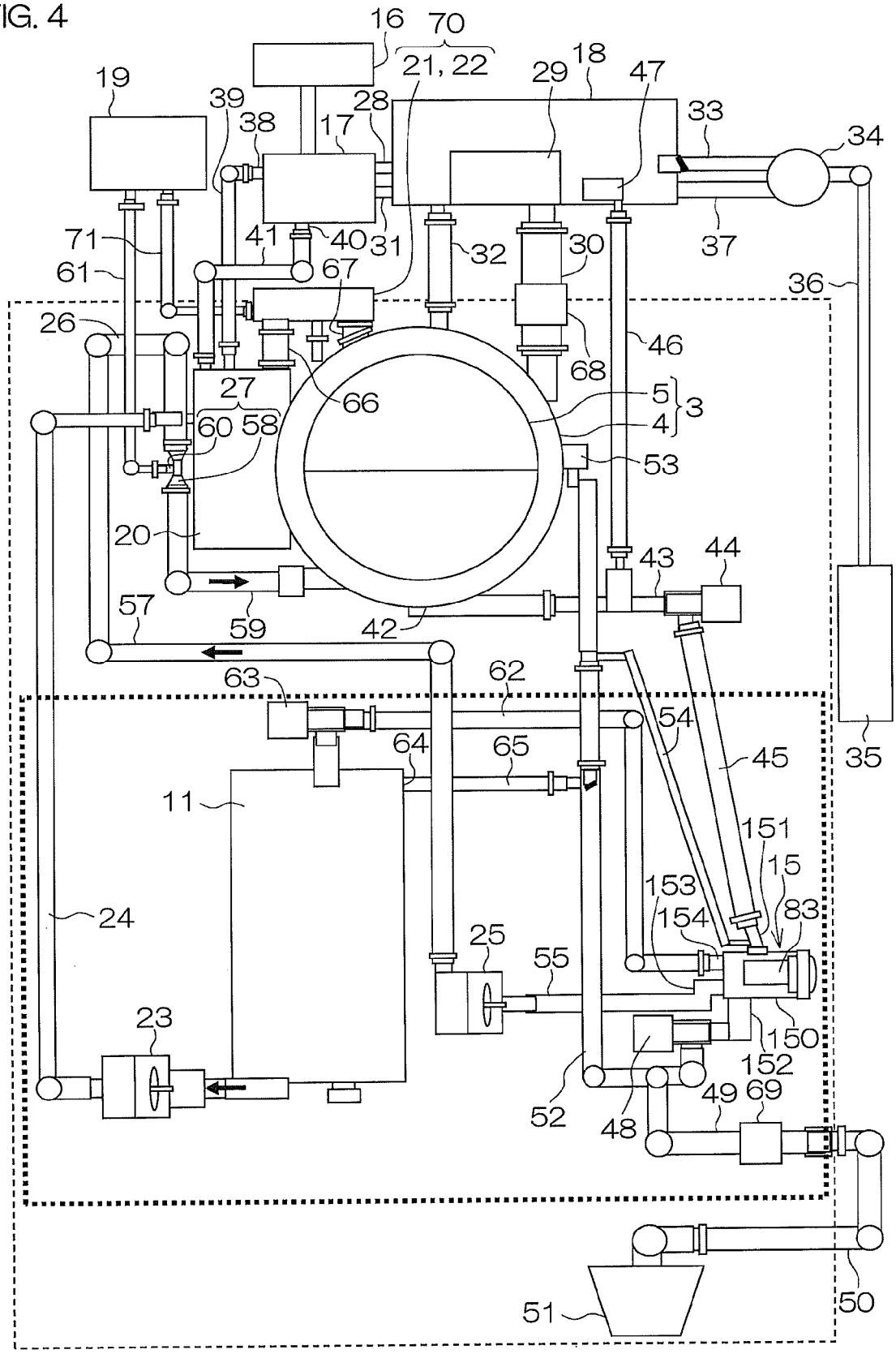
FIG. 4 is a schematic diagram mainly illustrating water passages and air passages of the washing/drying machine 1.

FIG. 4 is a schematic diagram mainly illustrating the water passages and the air passages of the washing/drying machine 1.

The water plug 16 is connected to an inlet of the water supply valve 17. The water supply valve 17 has four outlets through which the water is selectively caused to flow out. A first outlet port 28 of the water supply valve 17 is connected to the water supply port unit 18. Though not shown, the water supply port unit 18 includes a two-branch water passage having a water passage for guiding water supplied from the first outlet port 28 into a water supply passage 32 and a water passage for guiding the water supplied from the first outlet port 28 into a priming water passage 33. The water supplied into the water supply port unit 18 from the first outlet port 28 flows into the detergent container 29 mainly through the priming water passage 33, a bathwater pump 34 and a water passage 37. Then, the water flows through a detergent containing chamber defined in the detergent container 29 and then into the washing tub 3 through a water supply passage 30. A part of the water flowing into the water supply passage 32 through the branch water passage further flows over an inner surface of the door 10 (see FIG. 1) into the washing tub 3 from an upper portion of the door 10 provided on a front face of the washing tub 3. A second outlet port 31 of the water supply valve 17 is connected to the water supply port unit 18, and water supplied from the second outlet port 31 flows through a softener containing chamber defined in the detergent container 29 and then into the washing tub 3 through the water supply passage 30 when the second outlet port 31 is open.

When the bathwater pump 34 is driven, on the other hand, bathwater in a bathtub 35 is pumped up into the water supply port unit 18 through a bathwater hose 36 and the water passage 37, and flows through the detergent containing chamber of the detergent container 29 to be supplied into the washing tub 3 through the water supply passage 30.

Thus, the water is supplied into the washing tub 3 through the water supply passage 30.

A third outlet port 38 of the water supply valve 17 is connected to a predetermined portion of the drying air duct 20 via a water passage 39. A fourth outlet port 40 of the water supply valve 17 is connected to a predetermined portion of the drying air duct 20 via a water passage 41. The third outlet port 38 has a relatively small diameter, while the fourth outlet port 40 has a relatively great diameter. With the third outlet port 38 being open, therefore, a relatively small amount of water is supplied into the drying air duct 20 through the water passage 39. This water is brought into contact with the circulated high-temperature high-humidity air in the drying air duct 20 for the heat exchange. With the fourth outlet port 40 being open, a relatively great amount of water is supplied into the drying air duct 20 through the water passage 41. This water is used for washing away lint and other foreign matter contained in the air circulated upward in the drying air duct 20 and for washing away lint and other foreign matter adhering to an inner wall of the drying air duct 20.

In the laundry process (the washing step or the rinsing step), water is retained in the washing tub 3. A drain port 42 is provided in a lowermost bottom portion of the washing tub 3 (more specifically, in a lowermost bottom portion of the outer tub 4). An inlet port of a first drain valve 44 is connected to the drain port 42 via a water passage 43, and an outlet port of the first drain valve 44 is connected to an inlet port 151 of the filter unit 15 via a water passage 45. With the first drain valve 44 being closed, water can be retained in the washing tub 3 (outer tub 4). A water level in the washing tub 3 is detected by a water level sensor 47 based on a change in pressure in an air hose 46 branched from the water passage 43 and extending upward.

The filter unit 15 includes a case 150, and a filter body 83 provided in the case 150 for trapping foreign matter. The case 150 has a drain port 152, a first outlet port 153 and a second outlet port 154 in addition to the aforementioned inlet port 151. An inlet port of a second drain valve 48 is connected to the drain port 152, and an outlet port of the second drain valve 48 is connected to an external drain hose 50 and a drain trap 51 via a drain passage 49. With the first drain valve 44 and the second drain valve 48 being open, the water in the washing tub 3 is drained into the drain trap 51 through the drain port 42, the water passage 43, the first drain valve 44, the water passage 45, the filter unit 15, the drain port 152, the second drain valve 48, the drain passage 49 and the external drain hose 50.

Thus, the water in the washing tub 3 is drained from the drain port 42 through the drain passage 49 and the like.

One end (lower end) of an overflow water passage 52 is connected to the drain passage 49. The other end (upper end) of the overflow water passage 52 communicates with an overflow port 53 of the outer tub 4. Therefore, if water is retained in the washing tub 3 in excess to a water level not lower than a predetermined level, water overflows from the overflow port 53, and drained into the drain trap 51 through the overflow water passage 52, the drain passage 49 and the external drain hose 50 irrespective of the opening/closing state of the second drain valve 48.

An air pressure adjusting hose 54 is connected to a vertically middle portion of the overflow water passage 52 and the inlet port 151 of the filter unit 15. With the provision of the hose 54, the internal air pressure of the washing tub 3 is equal to an air pressure on the side of the inlet port 151 of the filter unit 15, thereby preventing the back flow of water in the filter unit 15 and other trouble.

One end of a first water circulation passage 55 is connected to the first outlet port 153 of the filter unit 15, and the other end of the first water circulation passage 55 is connected to a suction port of the circulation pump 25. One end of the second water circulation passage 57 is connected to an outlet port of the circulation pump 25. The second water circulation passage 57 extends upward to a position higher than an ordinary water level up to which the water is retained in the washing tub 3, and the other end of the second water circulation passage 57 is connected to a U-turn portion 26 which is U-turned from an upward direction to a downward direction. An upper end of a venturi tube 58 of the gas-liquid mixer 27 is connected to the U-turn portion 26. One end (upper end) of a third water circulation passage 59 is connected to a lower end of the venturi tube 58, and the other end (lower end) of the third water circulation passage 59 is connected to the lower portion of the rear face of the washing tub 3 (outer tub 4).

With the aforementioned arrangement, a predetermined amount of water is retained in the washing tub 3, and the circulation pump 25 is driven with the first drain valve 44 being open and with the second drain valve 48 being closed in the washing step and/or the rinsing step, whereby the water retained in the washing tub 3 is circulated from the drain port 42 through the water passage 43, the first drain valve 44, the water passage 45, the inlet port 151, the case 150, the first outlet port 153, the first water circulation passage 55, the circulation pump 25, the second water circulation passage 57, the U-turn portion 26, the venturi tube 58 and the third water circulation passage 59 into the washing tub 3.

The venturi tube 58 has an air inlet port 60, and the ozone generator 19 is connected to the air inlet port 60 via an air tube 61. If the ozone generator 19 is actuated when water flows through the venturi tube 58, air (cleaning air) containing the ozone generated by the ozone generator 19 flows through the air tube 61 and then into the venturi tube 58 through the air inlet port 60. A fundamental reason for the flow of the cleaning air into the venturi tube 58 is that there is a pressure difference (negative pressure) caused by the water flowing through the venturi tube 58. When the ozone is mixed with the circulated water, the circulated water is cleaned by the strong oxidation power and the sterilization power of the ozone. Thus, the laundry process can be performed in the washing tub 3 with the use of the cleaned water.

One end (lower end) of a storage water passage 62 is connected to the second outlet port 154 of the filter unit 15, and the other end (upper end) of the storage water passage 62 is connected to an inlet port of a water storage valve 63. An outlet port of the water storage valve 63 is connected to the tank 11. When the water storage valve 63 is opened with the first drain valve 44 being open, with the second drain valve 48 being closed and with the circulation pump 25 being de actuated after the completion of the rinsing step, for example, the water used for the rinsing operation and retained in the washing tub 3 flows into the tank 11 from the drain port 42 through the water passage 43, the first drain valve 44, the water passage 45, the inlet port 151, the case 150, the second outlet port 154, the storage water passage 62 and the water storage valve 63 by gravity (natural falling). Thus, the water used for the rinsing operation is stored as recycling water in the tank 11.

An overflow port 64 is provided at an upper portion of the tank 11. One end of a water passage 65 is connected to the overflow port 64, and the other end of the water passage 65 is connected to a middle portion of the overflow water passage 52. If water is retained in the tank 11 to a water level not lower than a predetermined level, the water overflows to the drain trap 51 from the overflow port 64 through the water passage 65, the overflow water passage 52, the drain passage 49 and the external drain hose 50.

In the washing/drying machine 1, the used water is retained in the tank 11, and reused as the recycling water in the drying process.

The washing/drying machine 1 includes the drying air duct 20 for a drying function.

The drying air duct 20 is disposed outside the washing tub 3 (outer tub 4). The drying air duct 20 is an air duct through which air sucked out of the washing tub 3 through the lower portion of the rear face of the outer tub 4 is circulated to flow into the washing tub 3 from a front upper portion of the outer tub 4. The drying air duct 20 includes a connection pipe 66, a filter blower unit 70 (including the blower 21 and the drying filter unit 22), and a connection pipe 67. That is, one end (lower end) of the drying air duct 20 is connected to the lower portion of the washing tub 3, and the other end (connection pipe 67) of the drying air duct 20 is connected to the upper portion of the washing tub 3. When the blower 21 is rotatively driven, air in the washing tub 3 is circulated from the washing tub 3 through the drying air duct 20. In other words, the blower 21 circulates the air from the washing tub 3 through the drying air duct 20.

As described with reference to FIG. 1, the heater 100, i.e., the drying heater A 124 and the drying heater B 125 (not shown), is provided in an air duct portion of the drying air duct 20 extending from the filter blower unit 70 to the connection pipe 67 for heating the circulated air. For example, semiconductor heaters may be used as the drying heaters.

Referring to FIG. 4, the air sucked out of the washing tub 3 is dehumidified in the drying air duct 20. Further, the foreign matter such as lint contained in the air circulated through the drying air duct 20 and the foreign matter adhering to the inner wall of the drying air duct 20 are washed away. Therefore, the recycling water retained in the tank 11 is circulated to flow through the drying air duct 20.

A suction port of the drying pump 23 is connected to the tank 11. One end of the duct water supply passage 24 is connected to an outlet port of the drying pump 23, and the other end of the duct water supply passage 24 is connected to the first position of the drying air duct 20. In the drying process, water flows through the duct water supply passage 24 to be supplied into the drying air duct 20 from the first position of the drying air duct 20 upon actuation of the drying pump 23. As described above, the supplied water is heat-exchanged with the air circulated upward from the lower side in the drying air duct 20, and washes away the lint and other foreign matter contained in the air and the foreign matter adhering to the inner wall of the drying air duct 20. Water flowing down together with the lint and other foreign matter in the drying air duct 20 further flows into the filter unit 15 from the lower portion of the outer tub 4 through the drain port 42, the water passage 43, the first drain valve 44 and the water passage 45. Then, the lint and other foreign matter are trapped and filtered away in the filter unit 15, and water free from the foreign matter flows back into the tank 11 from the second outlet port 154 through the storage water passage 62 and the water storage valve 63.

The washing/drying machine may be configured such that the water flowing down in the drying air duct 20 is drained, for example, from a lower end (second position) of the drying air duct 20 and flows back into the tank 11 rather than into the outer tub 4. In the drying process, a great amount of water is required for the heat exchange in the drying air duct 20 and for the removal of the lint and other foreign matter adhering to the inner wall of the drying air duct 20. The washing/drying machine 1 is configured such that the used water stored in the tank 11 is recycled for use as the water required for the heat exchange and the removal of the foreign matter. Thus, drastic water saving can be achieved. Since the water is circulated from the tank 11, the volume of the tank 11 is reduced. Even with the provision of the tank 11, the outer size of the washing/drying machine is not increased.

The ozone generator 19 is connected to the filter blower unit 70 via an air tube 71. In the drying process, the cleaning air containing the ozone generated by the ozone generator 19 is sucked into the filter blower unit 70 upon actuation of the ozone generator 19, and mixed with the air to be circulated into the washing tub 3. Ozone and ozone-containing air each serve as the cleaning air. The garment to be dried can be deodorized or sterilized (or air-washed) with the cleaning air. The sterilization and deodorization of the garment with the use of the cleaning air is referred to as "air wash" by the inventor of the present invention, because the garment is sterilized and deodorized as if it were washed with the cleaning air (air). The filter blower unit 70, the air tube 71 and the ozone generator 19 collectively serve as cleaning air supply means, or cleaning air supply system, for supplying the cleaning air into the washing tub 3.

The washing/drying machine 1 having such an air-wash function (deodorization function) is capable of performing an air-wash operation in the drying process, and is additionally capable of performing the air-wash operation in an air-wash process independently of the laundry process and the drying process. In the air-wash process, not only the garment but also daily commodities such as shoes, hats and bags can be deodorized in the washing tub 3. In the following description, it is assumed that the garment is air-washed for convenience.

For the air-wash operation, a water supply trap portion 68 is provided in the water supply passage 30, and a drain trap portion 69 is provided in the drain passage 49. When the air-wash operation is to be performed, a predetermined amount of water is supplied into the water supply passage 30 to retain the water in the water supply trap portion 68 to preliminarily form a water supply trap, and a predetermined amount of water is supplied into the drain passage 49 to retain the water in the drain trap portion 69 to preliminarily form a drain trap. Thus, the inside of the washing tub 3 is sealed, so that the cleaning air in the washing tub 3 is prevented from leaking outside the washing/drying machine 1 during the air-wash operation. The water supply passage 30 is connected to the detergent container 29 which communicates with the outside, and the drain passage 49 communicates with the outside via the external drain hose 50. Therefore, the water supply passage 30 and the drain passage 49 are most susceptible to leakage of the cleaning air from the washing tub 3. Therefore, the traps should be formed in the water supply passage 30 and the drain passage 49 prior to the air-wash operation.

On the other hand, check valves (not shown) are provided in water passages other than the water supply passage 30 and the drain passage 49, for example, in the water supply passage 32, the priming water passage 33 and the water passage 37. With the inlet and the outlets of the water supply valve 17 being closed, there is no possibility that the cleaning air leaks out of the washing tub 3 through the water plug 16. That is, there is almost no possibility that the cleaning air leaks out of the washing tub 3 through the water passages other than the water supply passage 30 and the drain passage 49.

The water supply trap portion 68 and the drain trap portion 69 will be described later in detail.

Configuration of Control Circuit for Air-Wash Process

Figure 5:
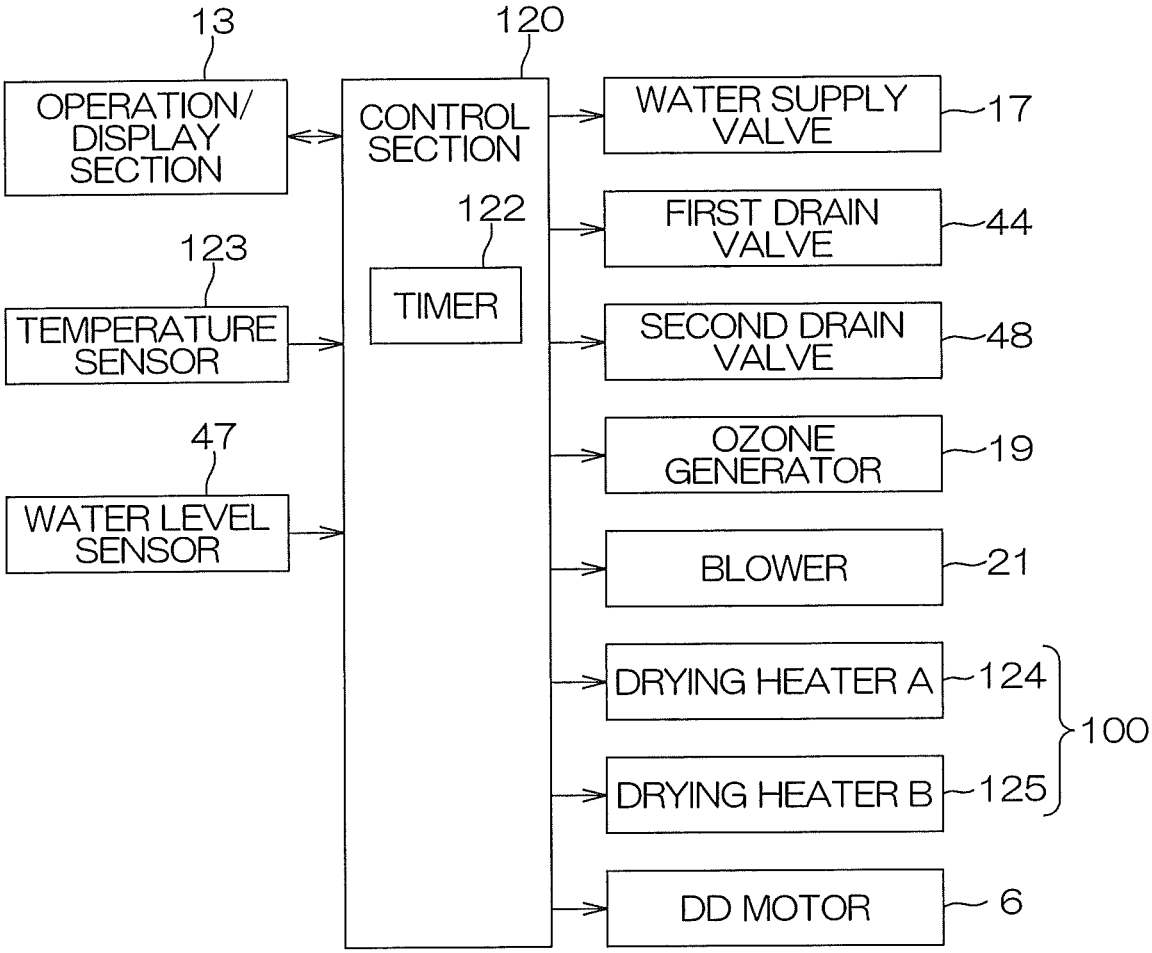
FIG. 5 is a block diagram for explaining the configuration of an electric control circuit related to an air-wash process to be performed by the washing/drying machine 1.

FIG. 5 is a block diagram for explaining the configuration of an electric control circuit related to the air-wash process to be performed by the washing/drying machine 1. In the block diagram of FIG. 5, only components required for performing the air-wash process in the washing/drying machine 1 are shown.

A control section 120 (control means) is a control center of the washing/drying machine 1, and includes a microcomputer. The control section 120 is provided, for example, in an electrical component 12 (see FIG. 1) provided in a front lower portion of the housing 2. A timer 122 (operation period setting means) is incorporated in the control section 120.

The operation/display section 13, a temperature sensor 123, the water level sensor 47, the water supply valve 17, the first drain valve 44, the second drain valve 48, the ozone generator 19, the blower 21, the heater 100 (the drying heater A 124 and the drying heater B 125) and the DD motor 6 are electrically connected to the control section 120. The temperature sensor 123 detects the temperature of the air in the washing tub 3.

When a user operates the operation keys (not shown) of the operation/display section 13 (see FIG. 1) for the air-wash process, the control section 120 controls the actuation and the driving of the respective components connected to the control section 120 based on the operation of the operation keys (operation start signal) to perform the air-wash process. At this time, the timer 122 sets an operation period, and measures an elapsed time.

Control Operation for Air-Wash Process

Figure 6:
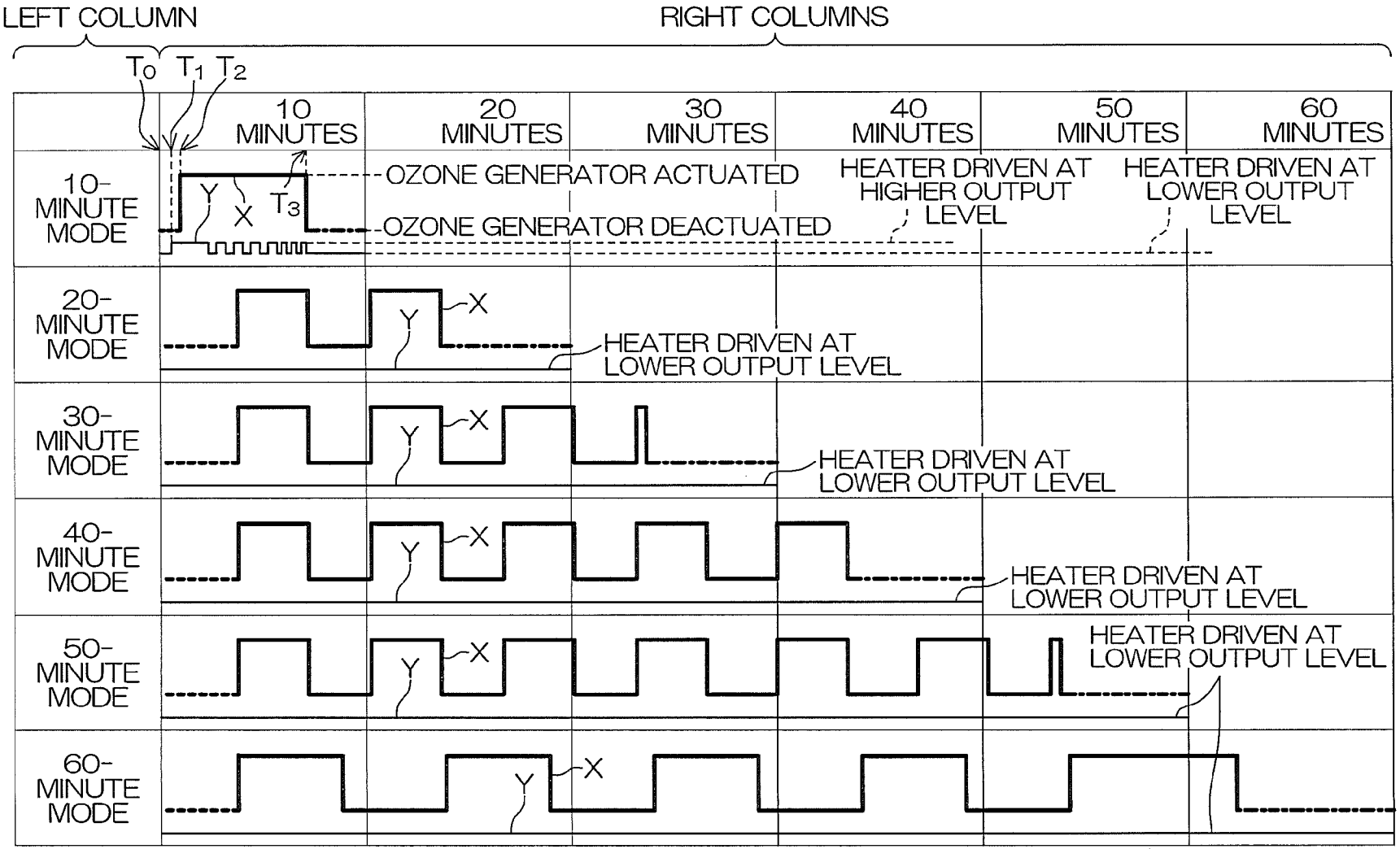
FIG. 6 is a timing chart for explaining the air-wash process.
Figure 7:
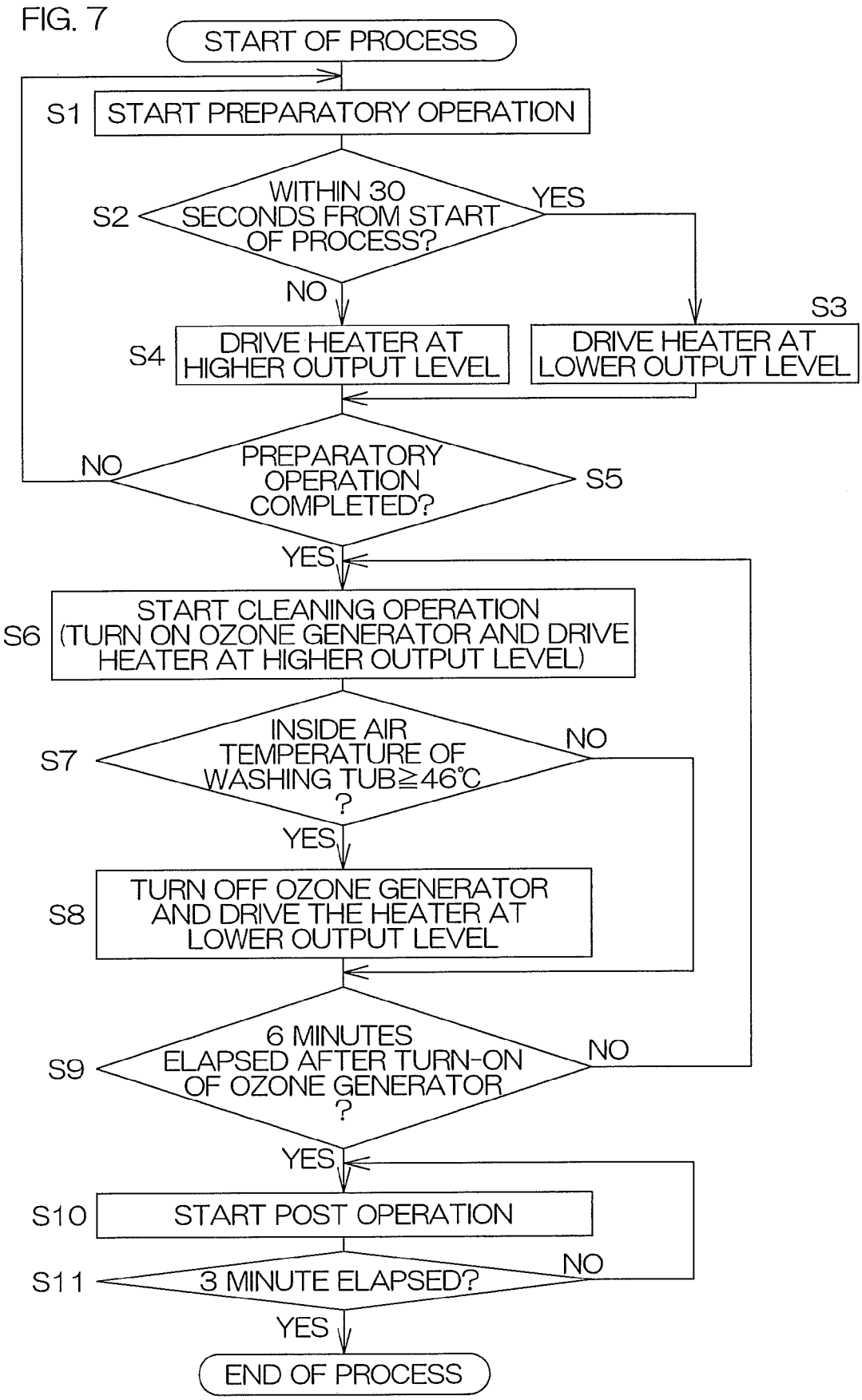
FIG. 7 is a flow chart for explaining a control operation to be performed by the washing/drying machine 1 for a minimum air-wash process.

FIG. 6 is a timing chart for explaining the air-wash process. FIG. 7 is a flow chart for explaining a control operation to be performed by the washing/drying machine 1 for a minimum air-wash process.

In the washing/drying machine 1, the air-wash process is performed in six modes according to the operation period. Further, the air-wash process is performed for different operation periods selectively with and without the rotation of the drum 5, so that the air-wash process is performed in a total of 12 modes. The user operates the operation keys (not shown) of the operation/display section 13 (see FIG. 1) to select one of the modes. Upon the selection of the mode, the timer 122 sets an operation period (also referred to as "deodorization operation period") according to the selected mode. Where shoes or a bag is air-washed, for example, the drum 5 is not rotated for prevention of scattering of the shoes and the bag.

More specifically, as shown in a left column in FIG. 6, there are a 10-minute mode, a 20-minute mode, a 30-minute mode, a 40-minute mode, a 50-minute mode and a 60-minute mode for the air-wash process according to the operation period (deodorization operation period). For example, the 10-minute mode in the left column in FIG. 6 indicates that the air-wash operation period (deodorization operation period) set by the timer 122 (see FIG. 5) is 10 minutes (ditto for the 20- to 60-minute modes). In right columns in FIG. 6, the actuation/driving states of the ozone generator 19 and the heater 100 (the drying heater A 124 and the drying heater B 125) are shown over time for the six modes of the air-wash process according to the operation period. The actuation state of the ozone generator 19 and the driving state of the heater 100 for each of the modes of the air-wash process are indicated by a bold line X and a thin line Y, respectively.

The 10-minute mode of the air-wash process is herein called "minimum air-wash process" and discriminated from the other 20- to 60-minute modes of the air-wash process. A deodorization period of 10 minutes for the minimum air-wash process is a minimum operation period predetermined for the washing/drying machine 1. The minimum air-wash process is performed, for example, when the user does not have enough time just before going out or when the garment is less odorous. Deodorization periods for the modes of the air-wash process other than the minimum air-wash process are 20 to 60 minutes. The 20-minute mode of the air-wash process is an ordinary air-wash mode, and the 60-minute mode of the air-wash process is a maximum air-wash mode. In the maximum air-wash mode, the cleaning air is applied to the garment for a relatively long period of time, so that the garment can be destained as well as deodorized.

In any of the modes of the air-wash process (12 air-wash modes), a preparatory operation, a cleaning operation and a post operation are performed in this order in the predetermined operation period (deodorization operation period).

In the preparatory operation, the inside of the washing tub 3 is sealed before the cleaning air is supplied into the washing tub 3. Referring to FIG. 4, more specifically, the control section 120 (see FIG. 5) judges, in response to the operation start signal, whether the door 10 (see FIG. 1) is completely closed. If the door 10 is not completely closed, a sealing failure occurs around the door 10 of the washing tub 3. Therefore, the control section 120 displays an alert message on the operation/display section 13 (see FIG. 5) to prompt the user to close the door 10.

If it is confirmed that the door 10 is completely closed, the control section 120 controls the water supply valve 17 to intermittently open the second outlet port 31 of the water supply valve 17. Here, the control section 120 performs a process sequence such that the second outlet port 31 is opened for 0.5 seconds and then closed for 20 seconds, and repeats this process sequence twice. Thus, the predetermined amount of water flows into the water supply passage 30 from the water plug 16 through the second outlet port 31 and the detergent container 29, so that a proper amount of water is retained in the water supply trap portion 68 to form the water supply trap. The water supply trap (the water retained in the water supply trap portion 68) in the water supply passage 30 seals the inside of the washing tub 3.

Simultaneously with the formation of the water supply trap, the control section 120 controls the water supply valve 17 to continuously open the third outlet port 38 and the fourth outlet port 40 of the water supply valve 17. Thus, the water from the water plug 16 flows through the water passage 39 or the water passage 41 and further flows down through the drying air duct 20, as described above, to be retained in the bottom of the washing tub 3 (more specifically, the outer tub 4). The level of the water retained in the washing tub 3 is detected by the water level sensor 47. When the water level in the washing tub 3 is increased to a predetermined water level (reset water level) lower than a lower end of the drum 5, the control section 120 closes the third outlet port 38 or the fourth outlet port 40 and opens the first drain valve 44 and the second drain valve 48 in response to the detection of the reset water level by the water level sensor 47. Thus, the water supplied up to the resent water level in the washing tub 3 flows from the drain port 42 to the drain passage 49, so that the water is retained in the drain trap portion 69 to form the drain trap as described above. In other words, the control section 120 supplies the predetermined amount of water directly to the drain port 42 through the water passage 39 or the water passage 41 and the drying air duct 20 to form the drain trap. The inside of the washing tub 3 is sealed by the drain trap (the water retained in the drain trap portion 69) in the drain passage 49. Here, the water passage 39, the water passage 41 and the drying air duct 20 are collectively defined as a separate water passage which is provided separately from the water supply passage 32. As described above, the control section 120 supplies the predetermined amount of water into the water supply passage 30 to retain the water in the water supply trap portion 68 to form the water supply trap, and supplies the predetermined amount of water directly to the drain port 42 from the separate water passage to retain the water in the drain trap portion 69 to from the drain trap. That is, the predetermined amount of water directly flows into the drain port 42 from the separate water passage rather than from the water supply passage 30 for the formation of the drain trap. Therefore, the drain trap can be formed without wetting the daily commodity in the washing tub 3 (more specifically, in the drum 5). The control section 120 may open both the third outlet port 38 and the fourth outlet port 40 to quickly supply the water to the reset water level in the washing tub 3.

In the preparatory operation, the control section 120 forms the traps in the water supply trap portion 68 and the drain trap portion 69, respectively, to seal the inside of the washing tub 3. Then, the control section 120 (see FIG. 5) continuously rotates the blower 21 at a relatively low speed (e.g., 2000 rpm).

It is also possible to check if the water plug 16 is free from malfunction by opening the third outlet port 38 and the fourth outlet port 40 of the water supply valve 17 for retaining the water in the drain trap portion 69 as described above. That is, if the water level sensor 47 does not detect that the reset water level is reached within a predetermined period after the third outlet port 38 and/or the fourth outlet port 40 are opened, it is judged that the water plug 16 malfunctions.

After the preparatory operation (the formation of the traps), the cleaning operation is performed. In the cleaning operation, the blower 21 is continuously rotated at the relatively low speed as in the preparatory operation.

In the cleaning operation, the control section 120 (see FIG. 5) actuates the ozone generator 19 during the rotation of the blower 21. Thus, the ozone (cleaning air) generated by the ozone generator 19 is sucked into the filter blower unit 70 through the air tube 71 to be supplied into the washing tub 3 as in the drying process described above. Thus, the garment in the washing tub 3 (more specifically, in the drum 5) is air-washed (deodorized) with the cleaning air. The cleaning air supplied into the washing tub 3 is circulated from the washing tub 3 through the drying air duct 20.

Where the air-wash process with the rotation of the drum 5 is selected by the user, the control section 120 (see FIG. 5) drives the DD motor 6 to rotate the drum 5 in the cleaning process. Thus, the garment is agitated by baffles 73 (see FIG. 1) of the drum 5, so that the cleaning air can be properly applied to the garment.

In the cleaning operation, the garment is thus cleaned with the cleaning air. It is noted that the ozone used for the deodorization of the garment is decomposed. Since the inside of the washing tub 3 is sealed in the preparatory operation described above, there is no possibility that the cleaning air (particularly, ozone) supplied into the washing tub 3 leaks out of the washing tub 3. At the end of the cleaning operation, the control section 120 turns off the ozone generator 19.

The post operation follows the cleaning operation.

In the post operation, the rotation speed of the blower 21 rotated continuously from the cleaning operation is increased, for example, from 2000 rpm to 2500 rpm by the control section 120. Thus, the circulation speed of the air circulated from the washing tub 3 through the drying air duct 20 is increased. Therefore, the ozone in the cleaning air is circulated at a relatively high speed. As a result, the ozone is decomposed through an oxidation reaction. That is, the blower 21 is thus operative (the blower 21 is driven in such a predetermined manner), whereby the cleaning air is circulated from the washing tub 3 and the cleaning air supplied into the washing tub 3 is eliminated. The circulation of the cleaning air is an example of a cleaning air elimination process to be performed by the cleaning air elimination means. The cleaning air supplied into the washing tub 3 can be reliably eliminated simply by driving the blower 21 in the predetermined manner to circulate the cleaning air from the washing tub 3 through the drying air duct 20.

Thus, the post operation is performed for eliminating the ozone remaining in the washing/drying machine 1 (more specifically, in the washing tub 3 and the drying air duct 20) after the cleaning operation. Since the post operation is performed, the cleaning air supplied into the washing tub 3 is eliminated by the end of the deodorization operation period. The control section 120 turns off the ozone generator 19 and stops the supply of the cleaning air to the washing tub 3 a predetermined period before the end of the deodorization operation period (i.e., at the end of the cleaning operation) so as to eliminate the cleaning air supplied into the washing tub 3 by the end of the deodorization operation period. Further, the control section 120 causes the blower 21 to be operative to eliminate the cleaning air (increases the rotation speed of the blower 21) in the post operation.

Thus, the preparatory operation, the cleaning operation and the post operation are thus performed in any of the modes of the air-wash process.

Referring to FIG. 5, the control section 120 properly drives the heater 100 (the drying heater A 124 and the drying heater B 125) to heat the air in the washing tub 3 to maintain the inside air temperature of the washing tub 3 within a predetermined temperature range in the preparatory operation, the cleaning operation and the post operation. More specifically, the heater 100 is driven at a lower output level by driving one of the drying heater A 124 and the drying heater B 125, and the heater 100 is driven at a higher output level by driving both of the drying heater A 124 and the drying heater B 125. That is, the heater 100 is driven selectively at the lower output level and at the higher output level by driving one or both of the drying heater A 124 and the drying heater B 125.

When the heater 100 is driven, the temperature sensor 123 monitors the inside air temperature of the washing tub 3 during the air-wash process.

In consideration of the intrinsic nature of the ozone, the heater 100 is driven to heat the cleaning air to some extent in the washing tub 3, whereby the humidity in the washing tub 3 is kept at an optimal level, for example, at 80%. This promotes the deodorization of the garment with the ozone. In this case, odorant is evaporated from the garment, and then decomposed by the ozone. On the other hand, if the inside air temperature of the washing tub 3 (the temperature of the cleaning air) exceeds a predetermined upper limit temperature (e.g., 50° C.), the ozone is decomposed by the heating. This reduces the garment deodorization efficiency of the ozone. In order to efficiently perform the air-wash process, therefore, the threshold temperature is set at 46° C. When the inside temperature of the drum 5 reaches 46° C., the control section 120 switches the driving of the heater 100 from the higher output level to the lower output level, or stops the driving of the heater 100.

Referring to FIGS. 6 and 7, the six modes of the air-wash process having different operation periods will be described. In FIG. 6, T0 indicates a time at which the minimum air-wash process is started, and T1, T2 and T3 indicate predetermined times in the minimum air-wash process. The bold line X indicating the actuation state of the ozone generator 19 includes a broken line portion for the preparatory operation, a solid line portion for the cleaning operation, and a one-dot-and-dash line portion for the post operation. In FIG. 6, upward projections of the bold line X indicating the actuation state of the ozone generator 19 indicate that the ozone generator 19 is on, and the other portions of the bole line X indicate that the ozone generator 19 is off. In FIG. 6, upward projections of the thin line Y indicating the actuation state of the heater 100 indicate that the heater 100 is driven at the higher output level, and the other portions of the thin line Y indicate that the heater 100 is driven at the lower output level or stopped.

In the 10-minute mode of the air-wash process (minimum air-wash process) having a minimum operation period, the heater 100 is driven at the lower output level for 30 seconds after the start of the process (during a period from the time T0 to the time T1 in FIG. 6). This prevents occurrence of a sudden change in electric current (so-called inrush current) when the heater 100 is thereafter driven at the higher output level. After a lapse of 30 seconds from the start of the process (at the time T1), the driving of the heater 100 is switched from the lower output level to the higher output level. Irrespective of the driving of the heater 100, the preparatory operation is performed for 1 minute (during a period from the time T0 to the time T2 in FIG. 6), and then the cleaning operation is performed for 6 minutes (during a period from the time T2 to the time T3 in FIG. 6). That is, the ozone generator 19 is actuated during the period from the time T2 to the time T3.

In the cleaning operation, the heater 100 is properly driven so that the inside air temperature of the washing tub 3 does not reach 46° C. That is, the driving of the heater 100 is switched from the lower output level to the higher output level after a lapse of 30 seconds from the start (the time T0) of the process (at the time T1) and, when the inside air temperature of the washing tub 3 thereafter reaches 46° C., the driving of the heater 100 is switched from the higher output level to the lower output level. When the inside air temperature of the washing tub 3 is thereafter reduced to a predetermined lower limit temperature (e.g., 43° C.) that is lower than 46° C., the driving of the heater 100 is switched again from the lower output level to the higher output level. In the cleaning operation of the minimum air-wash process, the control section 120 thus properly switches the driving of the heater 100 (i.e., the heater 100 is properly driven at the higher output level or at the lower output level) to maintain the inside air temperature of the washing tub 3 within the temperature range between 43° C. and 46° C. Thus, the inside air temperature of the washing tub 3 is efficiently maintained within the predetermined temperature range for the limited period of time (6 minutes), so that the air-wash process can be effectively performed. If the inside air temperature of the washing tub 3 is not lower than 46° C. even after the switching of the heater 100 from the higher output level to the lower output level, the heater 100 may be turned off.

Upon completion of the cleaning process (at the time T3 in FIG. 6), the ozone generator 19 is turned off and the post operation is started. At the start of the post operation, the driving of the heater 100 is switched from the higher output level to the lower output level. In the minimum air-wash process, the post operation is performed for 3 minutes.

Referring next to the flow chart of FIG. 7, the minimum air-wash process will be described in greater detail.

Upon the start of the minimum air-wash process, the preparatory operation is started (Step S1). That is, as described above, water is retained in the water supply trap portion 68 and the drain trap portion 69 to form the water supply trap and the drain trap to seal the inside of the washing tub 3. Upon the formation of the water supply trap and the drain trap, the water supply valve 17, the first drain valve 44 and the second drain valve 48 (see FIG. 4) are closed in order to further completely seal the inside of the washing tub 3.

The heater 100 is driven at the lower output level (Step S3) before a lapse of 30 seconds from the start of the minimum air-wash process (YES in Step S2). After a lapse of 30 seconds from the start of the minimum air-wash process (NO in Step S2), the driving of the heater 100 is switched from the lower output level to the higher output level (Step S4). That is, Step S3 corresponds to an operation performed during the period from the time T0 to the time T1 shown in FIG. 6, and Step S4 corresponds to an operation performed at the time T1.

Upon completion of the preparatory operation (YES in Step S5) after a lapse of 1 minute from the start of the minimum air-wash process, as described above, the cleaning operation is started (Step S6). That is, Step S6 corresponds to an operation performed at the time T2 shown in FIG. 6. Here, the ozone generator 19 is actuated, and the heater 100 is driven at the higher output level.

If the inside air temperature of the washing tub 3 does not reach the aforementioned threshold value (46° C.) in the cleaning operation (NO in Step S7), the ozone generator 19 is actuated and the heater 100 is driven at the higher output level continuously from Step S6. If the inside air temperature of the washing tub 3 reaches the threshold value (46° C.) (YES in Step S7), the driving of the heater 100 is switched from the higher output level to the lower output level as described above (Step S8). When the driving of the heater 100 is switched, the ozone generator 19 may be turned off. This prevents inefficient actuation of the ozone generator 19.

When the time elapsed from the start of the cleaning operation, i.e., from the turn-on of the ozone generator 19, reaches 6 minutes (YES in Step S9), the cleaning operation ends, and the post operation is started (see Step S10). Step S10 corresponds to an operation performed at the time T3 shown in FIG. 6. On the other hand, if the time elapsed from the turn-on of the ozone generator 19 does not reach 6 minutes (NO in Step S9), a process sequence from Step S6 is repeated. Here, if the inside air temperature of the washing tub 3 is lower than the aforementioned lower limit temperature (43° C.) after the driving of the heater 100 is switched from the higher output level to the lower output level and the ozone generator 19 is turned off in Step S8, the driving of the heater 100 is switched again from the lower output level to the higher output level and the ozone generator 19 is turned on again in Step S6.

After a lapse of 3 minutes from the start of the post operation (YES in Step S11), the minimum air-wash process is completed.

In the 10-minute minimum air-wash process, the preparatory operation is performed for 1 minute, the cleaning operation is performed for 6 minutes, and the post operation is performed for 3 minutes.

Referring to FIG. 6, in the 20-minute mode of the ordinary air-wash process, the preparatory operation is performed for 4 minutes, the cleaning operation is performed for 10 minutes, and the post operation is performed for 6 minutes. In the cleaning operation, more specifically, the ozone generator 19 is actuated for 3.5 minutes, then deactuated for 3 minutes, and actuated again for 3.5 minutes. That is, the ozone generator 19 is intermittently actuated so as to be operative for 7 minutes in total. Further, the heater 100 is continuously driven at the lower output level in the preparatory operation, the cleaning operation and the post operation.

In the 30-minute mode of the air-wash process, the preparatory operation is performed for 4 minutes, the cleaning operation is performed for 20 minutes, and the post operation is performed for 6 minutes. In the cleaning operation, more specifically, a process sequence such that the ozone generator 19 is actuated for 3.5 minutes and then deactuated for 3 minutes is repeated three times, and then the ozone generator 19 is actuated for 30 seconds. That is, the ozone generator 19 is intermittently actuated so as to be operative for 11 minutes in total. Further, the heater 100 is continuously driven at the lower output level in the preparatory operation, the cleaning operation and the post operation.

In the 40-minute mode of the air-wash process, the preparatory operation is performed for 4 minutes, the cleaning operation is performed for 30 minutes, and the post operation is performed for 6 minutes. In the cleaning operation, more specifically, a process sequence such that the ozone generator 19 is actuated for 3.5 minutes and then deactuated for 3 minutes is repeated four times, and then the ozone generator 19 is actuated for 4 minutes. That is, the ozone generator 19 is intermittently actuated so as to be operative for 18 minutes in total. Further, the heater 100 is continuously driven at the lower output level in the preparatory operation, the cleaning operation and the post operation.

In the 50-minute mode of the air-wash process, the preparatory operation is performed for 4 minutes, the cleaning operation is performed for 40 minutes, and the post operation is performed for 6 minutes. In the cleaning operation, more specifically, a process sequence such that the ozone generator 19 is actuated for 3.5 minutes and then deactuated for 3 minutes is repeated six times, and then the ozone generator 19 is actuated for 1 minute. That is, the ozone generator 19 is intermittently actuated so as to be operative for 22 minutes in total. Further, the heater 100 is continuously driven at the lower output level in the preparatory operation, the cleaning operation and the post operation.

In the 60-minute mode of the air-wash process, the preparatory operation is performed for 4 minutes, the cleaning operation is performed for 49 minutes, and the post operation is performed for 7 minutes. In the cleaning operation, more specifically, a process sequence such that the ozone generator 19 is actuated for 5 minutes and then deactuated for 5 minutes is repeated four times, and then the ozone generator 19 is actuated for 9 minutes. That is, the ozone generator 19 is intermittently actuated so as to be operative for 29 minutes in total. Further, the heater 100 is continuously driven at the lower output level in the preparatory operation, the cleaning operation and the post operation.

Referring to the respective modes of the air-wash process, the period of the supply of the ozone (cleaning air) is increased as the air-wash operation period is increased. Therefore, the amount of the ozone supplied into the washing tub 3 is increased, so that persistent dirt can be removed from the garment (the garment can be deodorized and sterilized). In this case, the post operation period is increased as compared with the minimum air-wash process, because the ozone supply amount is increased.

In the modes of the air-wash process other than the minimum air-wash process (i.e., where the operation period is other than the minimum operation period), the control section 120 (see FIG. 5) constantly drives the heater 100 at the lower output level to maintain the inside air temperature of the washing tub 3 within the predetermined temperature range between 43° C. and 46° C. Therefore, the inside air temperature of the washing tub 3 can be maintained within the predetermined temperature range without needlessly driving the heater 100 at the higher output level.

In the post operation of each of the modes of the air-wash process, the heater 100 is driven at the lower output level, so that the garment is not overheated. Therefore, the user can easily take the air-washed garment out of the washing tub 3 after the post operation, i.e., after the air-wash process.

In the washing/drying machine 1, as described above, the control section 120 (see FIG. 5) forms the traps in the water supply trap portion 68 of the water supply passage 30 and in the drain trap portion 69 of the drain passage 49 based on the aforesaid operation start signal prior to the deodorization (air-wash) of the garment. Thus, the washing tub 3 is sealed (see FIG. 4). After the formation of the traps, the garment retained in the washing tub 3 is deodorized with the cleaning air supplied into the washing tub 3. Since the washing tub 3 is sealed at this time, there is no fear that the cleaning air leaks out of the washing/drying machine 1 from the washing tub 3.

When the garment is deodorized with the cleaning air, the control section 120 causes the heater 100 to heat the air in the washing tub 3 to maintain the inside air temperature of the washing tub 3 within the predetermined temperature range (see FIGS. 5 and 6). Therefore, the deodorization with the cleaning air can be promoted, as long as the cleaning air is not decomposed by the heating. As a result, the garment can be satisfactorily deodorized irrespective of the operation period set by the timer 122 (see FIG. 5), for example, even if the garment is deodorized with the cleaning air in a shorter period of time (in the minimum air-wash process).

Then, the control section 120 stops the supply of the cleaning air to the washing tub 3 the predetermined period before the end of the deodorization operation period set by the timer 122 (Step S8 in FIG. 7), so that the cleaning air supplied into the washing tub 3 is eliminated by the end of the deodorization operation period set by the timer 122. Further, the control section 120 causes the blower 21 to be operative in the aforementioned manner (increases the rotation speed of the blower 21). Thus, the cleaning air supplied into the washing tub 3 is eliminated by the end of the deodorization period even in the minimum air-wash process. Therefore, the user does not feel uncomfortable with the odor of the cleaning air when taking the garment out of the washing tub 3.

The present invention described above is not limited to the embodiment described above, but various modifications may be made within the scope of the claims.

The ozone is used as the cleaning air by way of example, but not by way of limitation. Examples of the cleaning air include any gases having a cleaning function, i.e., a deodorization/sterilization function.

Figure 8:
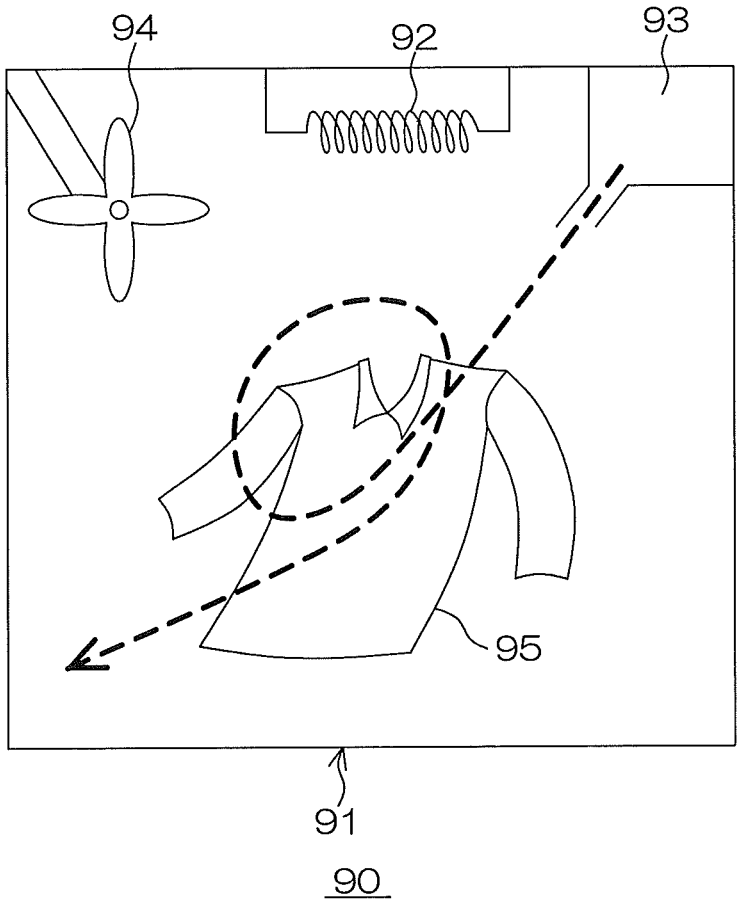
FIG. 8 is a schematic diagram of a deodorization apparatus 90 based on the present invention.

FIG. 8 is a schematic diagram of a deodorization apparatus 90 based on the present invention.

In the embodiment described above, the present invention is embodied as the washing/drying machine 1 by way of example, but may be applied to an apparatus having no washing/drying function to be embodied as the deodorization apparatus 90 shown in FIG. 8. The deodorization apparatus 90 includes a sealable container chamber 91, in which a daily commodity such as garment 95 is retained. The deodorization apparatus 90 further includes a heater 92, a fan 94 (blower means) and an ozone supply device 93. The heater 92 and the fan 94 are respectively equivalent to the heater 100 (heating means) and the blower 21 (cleaning air elimination means) in the embodiment described above. The ozone supply device 93 is equivalent to a combination of the ozone generator 19 and the air tube 71 (cleaning air supply means) in the embodiment described above (see FIG. 4).

The deodorization device 90 performs an air-wash process for air-washing the garment 95 as in the above embodiment by using ozone (cleaning air indicated by a broken line arrow) supplied into the container chamber 91 by the ozone supply device 93. Since the container chamber 91 is sealed, there is no possibility that the cleaning air leaks out of the container chamber 91 during the air-wash process. The deodorization apparatus 90 performs the air-wash process in the same manner as the washing/drying machine 1, so that the deodorization apparatus 90 provides the same effects as the washing/drying machine 1 in the air-wash process.

At the final stage of the air-wash process, the post operation described above is performed, in which the fan 94 is rotatively driven to agitate the air in the container chamber 91 and the cleaning air agitated in the container chamber 91 is decomposed through an oxidation reaction. That is, the cleaning air supplied into the container chamber 91 can be reliably eliminated simply by agitating the cleaning air in the container chamber 91 by the fan 94.

What is claimed is:

1. A washing/drying machine which has a deodorization function for deodorizing a daily commodity by using cleaning air, the washing/drying machine comprising:

a washing tub having a drain port;

a water supply passage through which water is supplied into the washing tub, the water supply passage having a water supply trap portion;

a drain passage through which water is drained out of the washing tub from the drain port, the drain passage having a drain trap portion;

a heating means which heats cleaning air in the washing tub;

a cleaning air supply means which supplies the cleaning air into the washing tub;

a cleaning air elimination means which eliminates the cleaning air supplied into the washing tub;

a separate water passage provided separately from the water supply passage, the separate water passage for supplying water directly to the drain port of the washing tub; and a control means including an operation period setting means which sets a deodorization operation period, the control means configured to form traps in the water supply trap portion and the drain trap portion based on an operation start signal, cause the cleaning air supply means to supply the cleaning air after the formation of the traps, cause the heating means to heat the cleaning air in the washing tub to maintain an inside air temperature of the washing tub within a predetermined temperature range, cause the cleaning air supply means to stop the supply of the cleaning air and turn on the cleaning air elimination means a predetermined period before an end of the deodorization operation period so as to eliminate the supplied cleaning air by the end of the deodorization operation period, supply a predetermined amount of water into the water supply passage to retain water in the water supply trap portion to form a water supply trap, and supply a predetermined amount of water directly into the drain port through the separate water passage to retain water in the drain trap portion to form a drain trap.

2. A washing/drying machine as set forth in claim 1, wherein the heating means includes a heater which is driven selectively at a higher output level and at a lower output level, and the control means drives the heater at the lower output level to maintain the inside air temperature of the washing tub within the predetermined temperature range if the deodorization operation period set by the operation period setting means is an operation period other than a predetermined minimum operation period.

3. A washing/drying machine as set forth in claim 2, wherein the control means drives the heater at one of the higher output level and the lower output level to maintain the inside air temperature of the washing tub within the predetermined temperature range if the operation period set by the operation period setting means is the predetermined minimum operation period.

4. A washing/drying machine as set forth in claim 3, further comprising:

a circulation air duct having opposite ends connected to the washing tub; and blower means which circulates air from the washing tub through the circulation air duct, wherein the cleaning air elimination means drives the blower means in a predetermined manner to circulate the cleaning air from the washing tub.

5. A washing/drying machine as set forth in claim 1, further comprising:

a circulation air duct having opposite ends connected to the washing tub; and blower means which circulates air from the washing tub through the circulation air duct, wherein the cleaning air elimination means drives the blower means in a predetermined manner to circulate the cleaning air from the washing tub.

6. A washing/drying machine as set forth in claim 2, further comprising:

a circulation air duct having opposite ends connected to the washing tub; and blower means which circulates air from the washing tub through the circulation air duct, wherein the cleaning air elimination means drives the blower means in a predetermined manner to circulate the cleaning air from the washing tub.

7. A washing/drying machine as set forth in claim 1, wherein each of the water supply passage and the drain passage has a valve.

8. A washing/drying machine which has a deodorization function for deodorizing a daily commodity by using cleaning air, the washing/drying machine comprising:

a washing tub having a drain port;

a water supply passage through which water is supplied into the washing tub, the water supply passage having a water supply trap portion;

a drain passage through which water is drained out of the washing tub from the drain port, the drain passage having a drain trap portion;

a heater which heats cleaning air in the washing tub;

a cleaning air supply system which supplies the cleaning air into the washing tub;

a blower which eliminates the cleaning air supplied into the washing tub;

a separate water passage provided separately from the water supply passage, the separate water passage for supplying water directly to the drain port of the washing tub; and a control section having a timer which sets a deodorization operation period, the control section being configured to form traps in the water supply trap portion and the drain trap portion based on an operation start signal, cause the cleaning air supply system to supply the cleaning air after the formation of the traps, cause the heater to heat the cleaning air in the washing tub to maintain an inside air temperature of the washing tub within a predetermined temperature range, cause the cleaning air supply system to stop the supply of the cleaning air and turn on the blower a predetermined period before an end of the deodorization operation period so as to eliminate the supplied cleaning air by the end of the deodorization operation period, supply a predetermined amount of water into the water supply passage to retain water in the water supply trap portion to form a water supply trap, and supply a predetermined amount of water directly into the drain port through the separate water passage to retain water in the drain trap portion to form a drain trap.

* * * * *